United States Patent [19]

Rickert et al.

[11] 4,211,251

[45] Jul. 8, 1980

[54] AUTOMATIC PURGING SYSTEM

[75] Inventors: Raymond E. Rickert, Terre Haute; Billy J. Swalls, Lewis, both of Ind.

[73] Assignee: Templeton Coal Co., Inc., Terra Haute, Ind.

[21] Appl. No.: 969,012

[22] Filed: Dec. 13, 1978

Related U.S. Application Data

[62] Division of Ser. No. 899,412, Apr. 24, 1978, Pat. No. 4,169,225.

[51] Int. Cl.[2] ..... E03B 5/00; H05B 3/58

[52] U.S. Cl. ..... 137/565; 137/209; 219/433; 219/437; 219/496; 219/521; 219/535; 220/88 B; 220/420; 222/53

[58] Field of Search ..... 219/430, 431, 432, 433, 219/438, 439, 440, 441, 492, 493, 496, 521, 535; 220/88, 88 B, 420; 137/1, 87, 209; 62/42; 251/61; 236/46; 229/53; 137/565, 565.1, 565.2

[56] References Cited

U.S. PATENT DOCUMENTS

| | | | |
|---|---|---|---|
| 1,097,470 | 5/1914 | Rolland et al. | 222/53 |
| 2,193,066 | 3/1940 | Gill | 137/343 X |
| 2,406,373 | 8/1946 | Heigis | 220/88 B |
| 2,740,604 | 4/1956 | Swigart et al. | 251/61 |
| 2,987,605 | 6/1961 | Brandl | 219/302 |
| 2,989,969 | 6/1961 | Gascoin | 137/1 |
| 3,005,888 | 10/1961 | Putz | 200/83 |
| 3,041,841 | 7/1962 | Henry | 62/42 |
| 3,587,618 | 6/1971 | Kenyon | 220/88 B X |
| 3,662,948 | 5/1972 | Puster | 236/46 |
| 3,777,928 | 12/1973 | Kober | 220/88 B |

FOREIGN PATENT DOCUMENTS

| | | | |
|---|---|---|---|
| 529635 | 11/1940 | United Kingdom | 219/535 |
| 833898 | 5/1960 | United Kingdom | 220/88 B |

*Primary Examiner*—Volodymyr Y. Mayewsky
*Attorney, Agent, or Firm*—Albert L. Jeffers; John F. Hoffman

[57] ABSTRACT

A system for automatically purging heating mantles and other apparatus including an enclosed volume capable of low level pressurization. The system comprises a pressure sensor for sensing the fluid pressure within the enclosure, which may be the space between a heating mantle poncho and the enclosed flask, and a fluidic logic circuit which is responsive to a low pressure condition within the enclosure to deactivate the heating element in the mantle. At the same time, the logic circuit causes a predetermined volume of purging gas to flow through the enclosure and, after this has been accomplished, reactivates the heating element and reestablishes the minimum pressure conditions by flowing a small volume of purging gas into the enclosure. The system is particularly intended for use in hazardous locations where explosion-proof electrical equipment enclosures are normally mandatory. In order to avoid the enclosing of the purging system in an explosion-proof enclosure, all of the control functions are accomplished by fluidic-mechanical logic and control components, thereby virtually eliminating the necessity for electrical control equipment. In cases where electrical switches and relays are used to disconnect the heating element from its source of supply, these may be located remotely from the hazardous location and controlled by fluid pressure signals transmitted thereto over control tubing.

4 Claims, 2 Drawing Figures

AUTOMATIC PURGING SYSTEM

This is a division, of application Ser. No. 899,412, filed Apr. 24, 1978, now U.S. Pat. No. 4,169,225.

BACKGROUND OF THE INVENTION

The present invention relates to an automatic purging system and in particular to a system which is adapted for automatically purging heating mantle and poncho assemblies.

In hazardous locations, for example in the processing of certain flammable chemicals such as acetone and toluene, electrical equipment which is not explosion-proof as defined by the National Electrical Code cannot be used. The Code provides, however, that in certain cases, hazards and hazardous locations may be limited or eliminated by adequate positive pressure ventilation from a source of clean air in conjunction with effective safeguards against ventilation failure. Since providing explosion-proof electrical equipment is quite expensive, it is often desirable to resort to the alternative procedure of maintaining positive pressure ventilation.

Standard 496 of the National Fire Protection Association sets forth the procedures for purging enclosures for electrical equipment in hazardous locations. Basically, what the standard requires is that if the positive ventilation or purging should fail as indicated by failure to maintain a static pressure within the enclosure of at least 0.1 inch of water, power shall be cut off to the electrical equipment and the power shall not be turned on again until at least four enclosure volumes of purged gas have passed through the enclosure while maintaining an internal enclosure pressure of at least 0.1 inch of water.

In chemical processing installations, such as the distillation of flammable organic chemicals, the chemicals are normally heated in a flack supported in a heating mantle which includes an electric heating element. The top of the heating mantle and the flask are enclosed by a poncho safety shield. This shield has an opening which fits tightly around the neck of the flask, is sealed against the mantle and is spaced slightly from the flask so as to provide an enclosure capable of pressurization. The metal poncho protects the flask, which is often made of glass, against damage from falling objects and also protects personnel from flying glass and the contained liquid should a flask explode or implode. Furthermore, since the poncho is spaced from the flask, it provides an insulating barrier which substantially reduces heat losses. The poncho also serves as protection for the heating element of the mantle against damage by chemical spillage or washdown of the apparatus. A factor which is important from the standpoint of the present invention is that since the poncho seals tightly against the flask and mantle, the enclosure can be placed under a positive pressure for purging.

SUMMARY OF THE INVENTION

The present invention relates to a system for purging enclosed heating apparatus, such as heating mantles and other electrical equipment, in hazardous environments wherein explosion-proof electrical equipment is normally required. The system is suitable for use in such hazardous environments because all of the logic and control components are fluidicmechanical in nature and the use of electrical control components in the environment is completely avoided.

The invention is a fluidic control system for purging an enclosure for electrical equipment and the like in hazardous environments comprising: a purging gas inlet adapted to be connected to a supply of purging gas such as instrument quality air, a purging gas outlet adapted to be connected to the enclosure, condition sensing means for sensing a condition within the enclosure, such as pressure, and providing a first control pressure at a control inlet when the sensed condition has exceeded a predetermined limit, and a control pressure outlet. The system further comprises first fluidic logic means responsive to the first control pressure for providing a second control pressure at the control pressure outlet, second fluidic logic means for flowing a predetermined volume of purging gas from the purging gas inlet to the purging gas outlet in response to the first control signal, and third fluidic logic means for continuously providing low pressure purging gas from said purging gas inlet and said purging gas outlet at least in the absence of said first pressure at said control inlet.

It is an object of the present invention to provide an automatic purging system for electrical equipment in hazardous locations which employs a fluidic logic system thereby eliminating expensive and bulky explosion-proof housings which would otherwise be necessary if electrical circuitry were used.

Another object of the present invention is to provide an automatic purging system for electrical equipment in hazardous locations wherein spark and shock hazards are eliminated through the use of fluidic logic controls.

Yet another object of the present invention is to provide an automatic purging system for electrical equipment, such as heating mantles, in hazardous locations wherein the loss of positive pressure ventilation automatically initiates a purging cycle which first deactivates the electrical equipment, purges the enclosure within which the equipment is contained by the prescribed volume of gas, and reactivates the equipment once positive pressure ventilation is reestablished.

A further object of the present invention is to provide a purging system for electrical equipment in hazardous locations which is fully automatic thereby eliminating the necessity for constant monitoring by the operator.

These and other objects in the features of the present invention will be apparent from the detailed description considered together with the accompanying drawings.

DETAILED DESCRIPTION

Figure 1:
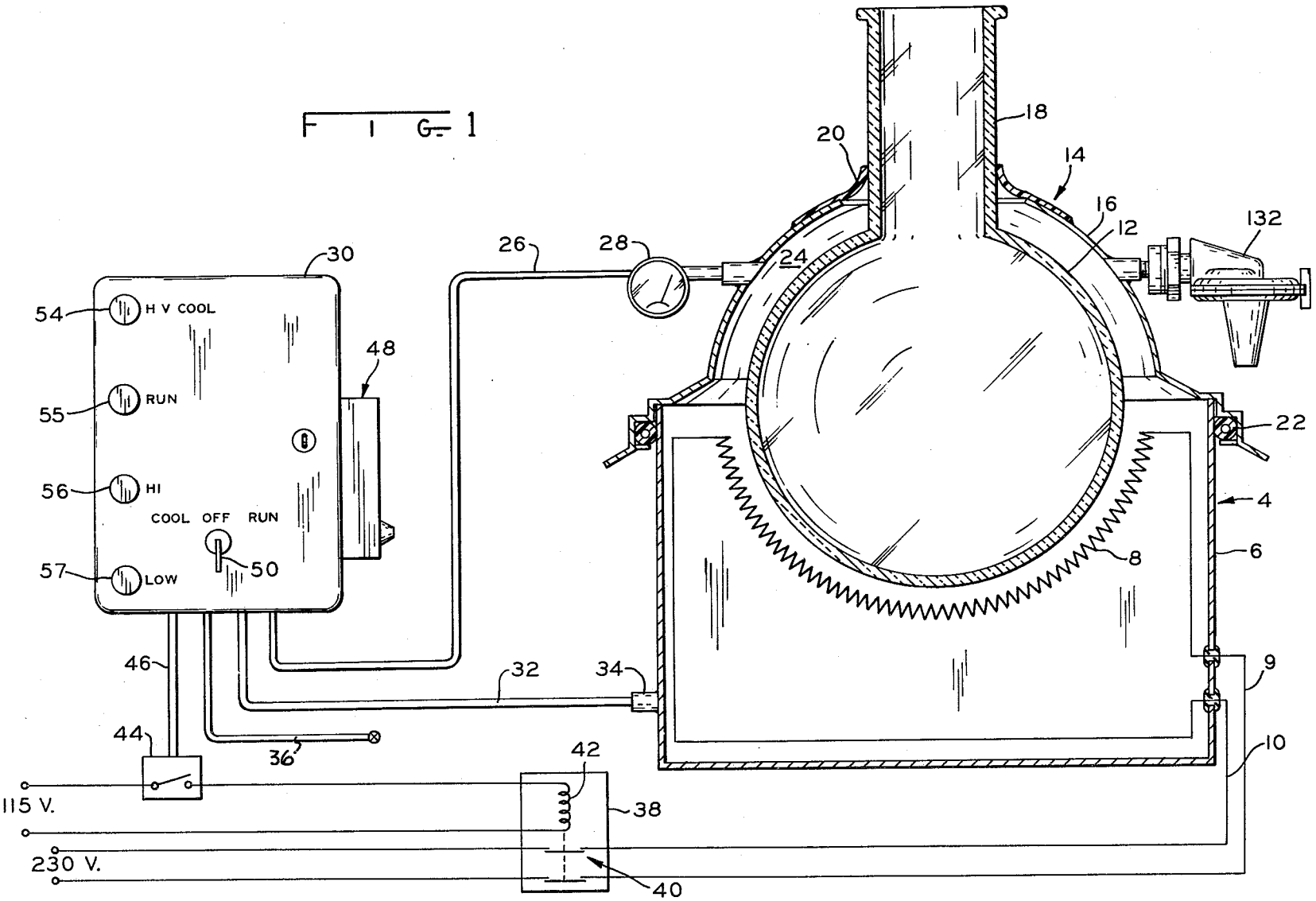
FIG. 1 is a schematic view showing a heating mantle and poncho assembly connected to a purging system according to the present invention.

Referring now to FIG. 1, the system according to the present invention is shown in combination with a ponchoenclosed heating mantle. Mantle 4 comprises a housing 6 within which is disposed an electric heating element 8 having electrical supply leads 9 and 10. A glass flask 12 is supported within housing 6 and is in good thermal contact with heating element 8 through a suitable thermal fabric (not shown).

Poncho 14 comprises a spun aluminum shield 16 having an opening through which the neck 18 of flask 12 protrudes. An elastic silicone rubber gasket 20 grips the neck 18 of flask 12 so as to provide a good seal therearound and is attached to shield 16 by any suitable means, such as silicone rubber cement. Poncho 14 is sealed around mantle housing 6 by a resilient silicone sealer ring 22. By these means, a substantially airtight enclosure 24 is provided between flask 12 and poncho 14 and within mantle housing 6.

Tubing 26 is connected to poncho 14 through pressure guage 28 so as to be in fluid communication with enclosure 24. The other end of tubing 26 is connected to the control circuitry in cabinet 30. Purging gas supply outlet tubing 32 is connected between the circuitry in control cabinet 30 and the interior of mantle housing 6 through connector 34 so that when purging gas is supplied to mantle 14 through tubing 32 it will flow around heating element 8 and up into the enclosed space 24 between poncho 14 and flask 12. Tubing 36 is connected between the control circuitry and a source of purging gas supply. The purging gas may be a suitable inert gas such as argon or instrument quality air which has been filtered to 40 microns, for example. Supply leads 9 and 10 for heating element 8 are connected to a source of supply voltage by relay 38 which includes contacts 40 and coil 42. Relay 38 is energized by means of a second source of voltage connected to coil 42 through pressure actuated switch 44, which is connected to the control circuitry in cabinet 30 over tubing 46.

Control cabinet 30 includes high volume and low volume flow indicators 48, a switch 50 for turning the system on and off and condition indicators 54, 55, 56 and 57. The indicators 54, 55, 56 and 57 are fluid pressure actuated mechanical indicators having transparent windows and variously colored elements therein which are moved or expanded so as to become visible when actuated. Indicator 54 is acuated during the high volume cool cycle, indicator 55 is actuated during the run cycle when pressure conditions are normal, indicator 56 is actuated under abnormally high conditions and indicator 57 is acuated under low pressure conditions.

To initiate operation of the system switch 50 is first turned to the RUN position and since the pressure within enclosed area 24 will be below 0.1 inches of water, the LOW indicator will be actuated. As soon as the pressure within enclosure 24 reaches approximately 0.2 inches of water, the LOW indicator 57 will be deactivated and the HV COOL indicator 54 will be activated. At that point, high volume purging gas will be flowed into housing 6 through tubing 32 and when four volumes of purging gas have flowed through the mantle housing 6 and the enclosed space between poncho 14 and flask 12, the high volume flow will be terminated, indicator 54 will be deactivated and the RUN indicator 55 will be activated. At this point, if mantle housing 6 and poncho 14 are sealed and a pressure of at least 0.1 inches of water is present therein, fluid pressure in tubing 46 will close switch 44 thereby applying voltage to coil 42. This will close contacts 40 so as to apply voltage to heating element 8. If the pressure within enclosure 24 is below 0.1 inches of water, indicator 57 will be activated and switch 44 will remain open. The actuation of RUN indicator 55 indicates that heating element 8 is being energized.

The low volume flow of purging gas in the run cycle is such that if either of seals 20 or 22 are defective or for some other reason enclosure 24 or the interior of mantle housing 6 should be open to the atmosphere, there will be insufficient air flow to maintain the 0.1 inches of water. This will cause the LOW indicator 57 to come on and switch 44 to open such that heating element 8 is deenergized. When the minimum low pressure is again established within enclosure 24, the aforementioned four volume purging cycle will repeat itself after which heating element 8 will again be energized.

In the event high pressure conditions should exist within enclosure 24, for example pressure greater than four inches of water, HI indicator 56 will come on and pressure switch 44 will be open so as to deenergize heating element 8. The system will remain in this condition until the pressure within enclosure 24 is reduced to the operating range whereupon the RUN indicator 55 will again be actuated and switch 44 will be closed so as to reenergize mantle 8. Since the pressure within enclosure 24 was always above the 0.1 inches of water minimum, no high volume purging is necessary.

When switch 50 is turned to the COOL position, high volume purging gas flows through the unit continuously. This may be done to cool the unit at the end of the processing.

Figure 2:
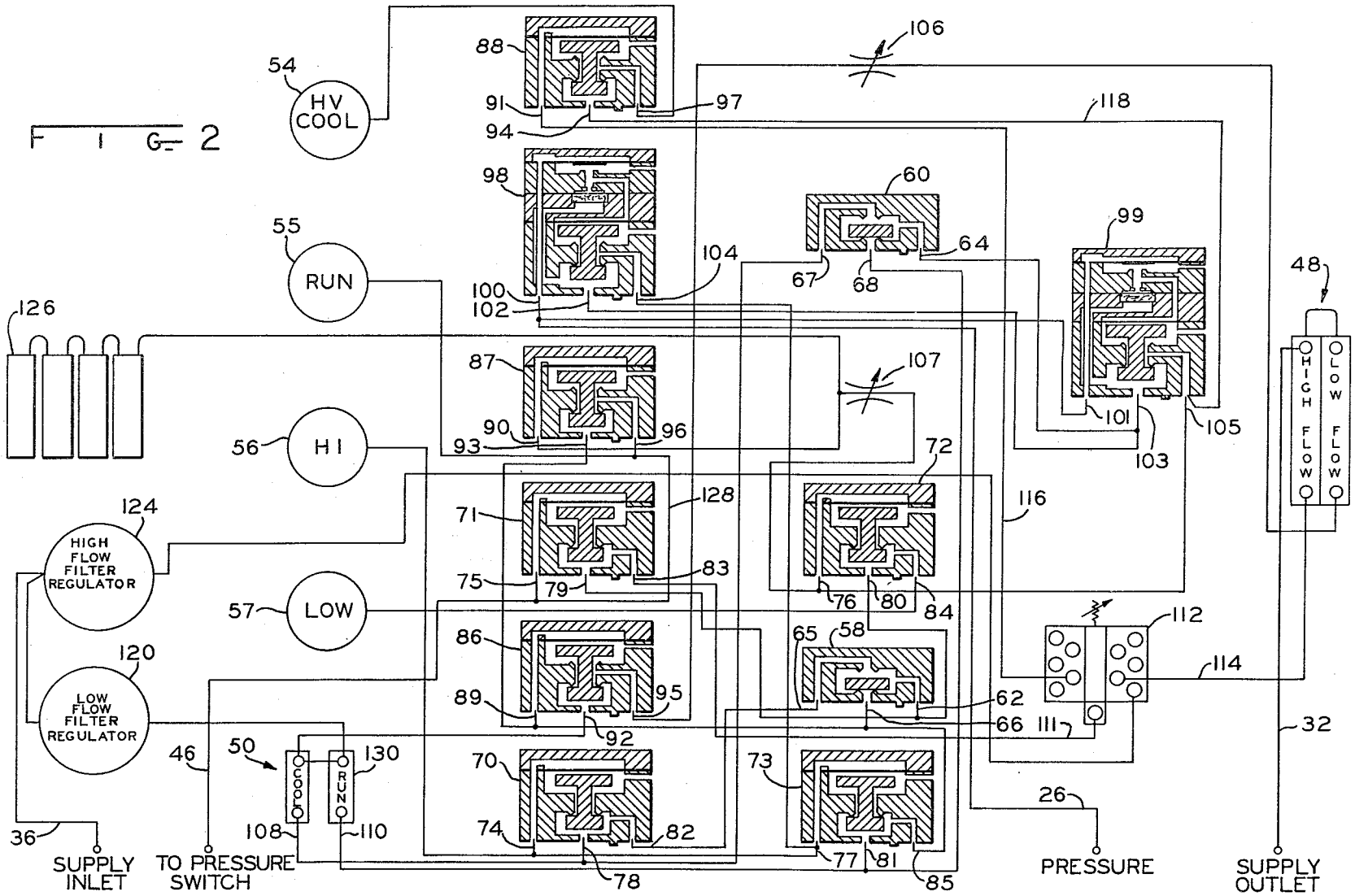
FIG. 2 is a detailed schematic of the fluidic logic and control circuit for the purging system.

Turning now to FIG. 2, the details of the pneumatic logic and control circuit are shown. This circuit comprises a plurality of fluidic logic elements which are commercially available and are interconnected to produce the purging and control cycles discussed previously.

Elements 58 and 60 are OR elements which produce output pressures at their outputs 62 and 64 whenever a control pressure is present at either of their inputs 65 or 66 and 67 or 68, respectively. Elements 70, 71, 72 and 73 are NOT elements and operate such that when there is no control pressure at respective control inlets 74, 75, 76 and 77, the respective control pressures at inlets 78, 79, 80 and 81 will be present at respective outputs 82, 83, 84 and 85. Elements 86, 87 and 88 are YES elements and when a control pressure is present at the respective control inlets 89, 90 and 91, the control pressures at respective inlets 92, 93 and 94 will be present at respective outputs 95, 96 and 97.

Elements 98 and 99 are 1 to 1,000 and 1 to 10,000 respectively, normally closed amplifiers and operate such that when a control pressure is present on respective inlets 100 and 101 the supply pressure on respective inlets 102 and 103 will be present on respective outlets 104 and 105. When no control pressure is present on inlets 100 and 101, no pressure will be present on outlets 104 and 105. Elements 106 and 107 are manually adjustable flow controllers.

OR element 60 is connected to the output lines 108 and 110 of switch 50 so that regardless of whether switch 50 is turned to COOL or RUN an output pressure will be developed on the output line 64, which is connected to the supply inlet 103 of amplifier 99 and the supply inlet 102 of amplifier 98. When switch 50 is turned off, no supply pressure will be supplied to amplifiers 98 and 99 so that purging gas is not wasted.

When switch 50 is turned to the COOL position, a supply pressure is developed at inlet 78 of NOT element 70 and then the same pressure will be produced at its outlet 82. The air then flows out of the outlet 62 of OR element 65 to the supply inlets 79 of NOT element 71 and from there over line 111 to pilot valve 112. This actuates pilot valve 112 which supplies high flow air to the unit over line 114, flow indicator 48 and outlet line 32. Pressure in line 116 from pilot valve 112 will cause the pressure in line 118 from amplifier 99 into flow outlet 97 of YES element 88 to the high volume cool indicator 54, thereby actuating the same.

When switch 50 is switched to the RUN position, air from supply inlet 36 and low flow filter regulator 120 flows through line 110 into NOT element 73 by way of inlet 81. The air also flows to inlet 68 of OR element 60 and from there it pressurizes amplifiers 99 and 98 in the manner described above. Since NOT element 73 is not actuated, the air flowing therein immediately flows out through outlet 85 into OR element 58 through inlet 66, into YES element 86 through 89 and into YES element 87 through supply inlet 93. The air passing into OR element 58 through inlet 66 exits through outlet 62 and flows into NOT element 71 through inlet 79. Since no pressure signal is present at the inlet 75 of NOT element 71, the air flowing therein over inlet 79 immediately passes out through outlet 83 and actuates pilot valve 112 to pass high flow air from regulator 124 and line 116 to supply outlet line 32 through line 113 and indicator 48. As can be seen, as soon as switch 50 is turned to the RUN position, high flow air is immediately applied to the system so as to begin purging the enclosure 24.

As soon as the pressure within enclosure 24 as sensed in line 26 exceeds the minimum (for example, 0.1 inches of water), the pressure at inlet 101 of amplifier 99 will cause amplifier 99 to open and introduce pressure at inlet 76 of NOT element 72. This terminates the flow of air through outlet 84 so as to turn off low pressure indicator 57. The system is preferably set so that the low pressure indicator 57 is turned off when the enclosure pressure reaches approximately 0.2 inches of wate. The air from the outlet 105 of amplifier 99 also flows through flow control valve 107 to control inlet 90 of YES element 87 and also begins to fill timer tanks 126. After a certain period of time, tanks 126 will fill up with air and become pressurized thereby creating a pressure at inlet 90 of YES element 87 which is sufficient to open it and cause air to flow from outlet 96 to RUN indicator 55. The pressure at outlet 96 is transmitted over line 128 to the control inlet 75 of NOT element 71 thereby turning it off so that pilot valve 112 is closed. Also, high pressure is transmitted to pressure switch 44 over line 46 thereby closing it and activating solenoid 38 to provide supply voltage to heating element 8. Relief valve 132 vents the high pressure air from enclosure 24. High volume flow is typical at 20 psi and 150 SCFH.

At this time, if flow control valve 106 is open sufficiently, it will maintain a low pressure in the unit to compensate for small amounts of leakage. This is the mechanism for maintaining the minimum positive pressure ventilation required for hazardous locations.

If for some reason the pressure in the system becomes too high, 1 to 1,000 amplifier 98 will open by virtue of the high pressure on control inlet 100. Air from outlet 104 of amplifier 98 will turn off NOT element 73 thereby terminating the flow of air from switch 130. In the manner described above, pressure switch 44 will be deactivated until such time as the high pressure condition is abated. High pressure from amplifier 98 outlet 104 also turns on high pressure indicator 56.

If at any time a low pressure condition should occur, the poppet in amplifier will vent the tanks 126 to the atmosphere and no timing air flow would be transmitted to YES element 87 or to timer tanks 126. With YES element 87 turned off, there will be insufficient pressure in line 46 to actuate pressure switch 44. As soon as the minimum low pressure has been reestablished, the high volume purging cycle would again be initiated followed by a continuous RUN condition. If the minimum pressure is not established, no purging will occur.

Although the system described above monitors only the pressure conditions within enclosure 44, other process conditions could also be monitored. For example, a liquid level control could be incorporated into the system so that the heating elements would not be energized unless at least minimum pressure conditions were met and the proper amount of liquid was present in the processing vessel. It would also be possible to sense other physical conditions such as process pressure, process vacuum, temperature, etc. Although it may be necessary to employ small electrical detectors for certain of these processed conditions, they could be enclosed within small explosion-proof enclosures which are relatively inexpensive. The control logic, however, would be accomplished by the fluidicmechanical system described above which is acceptable for use in hazardous locations.

It should be noted that "control pressure" as used in the claim is not necessarily a positive pressure but should be construed to include negative pressures or the absence of pressure. Furthermore, the term "heating element" encompasses any controllable source of heat such as gas burners, induction heaters, etc. The invention is not restricted to heating mantle and poncho assemblies only, and is equally adaptable for use with sealed heating mantles without ponchos, and to other types of equipment and enclosures.

While this invention has been described in terms of a preferred enbodiment, it will be understood that it is capable of further modification. This application is, therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the limits of the appended claims.

What is claimed is:

1. A fluidic control system for purging an enclosure for electrical equipment and the like comprising:

a purging gas inlet, a purging gas outlet adapted to be connected to the enclosure, condition sensing means for sensing a condition within the enclosure and providing a first control pressure at a control inlet when the sensed condition has exceeded a predetermined limit, a control pressure outlet, first fluidic logic means responsive to said first control pressure for providing a deactivating control pressure at said control pressure outlet, second fluidic means for flowing a predetermined volume of said purging gas from said purging gas inlet through said purging purging gas outlet in response to said first control signal, third fluidic logic means for continuously providing low pressure purging gas from purging gas inlet at said purging gas outlet at least in the absence of said first control pressure at said control inlet.

2. The system of claim 1 wherein said condition sensing means comprises pressure sensor means for producing said first control pressure when the pressure sensed thereby falls below a predetermined pressure level.

3. The system of claim 2 including four fluidic logic means for disabling said second fluidic logic means from flowing purging gas through said purging gas outlet until said sensed pressure reaches or exceeds said predetermined pressure level.

4. The system of claim 2 wherein said first fluidic logic means provides an activating control pressure at said control pressure outlet after the predetermined volume of purging gas is flowed through said purging gas outlet by said second fluidic logic means only if said sensed pressure is at or above said predetermined pressure level.

* * * * *

UNITED STATES PATENT AND TRADEMARK OFFICE

CERTIFICATE OF CORRECTION

PATENT NO. : 4,211,251

DATED : July 8, 1980

INVENTOR(S) : Raymond E. Rickert and Billy J. Sevalls

It is certified that error appears in the above-identified patent and that said Letters Patent are hereby corrected as shown below:

Col. 1, line 38, "flack" should be -- flask --

Col. 2, lines 57 and 58, "ponchoenclosed" should be -- poncho-enclosed --.

Col. 5, line 26, "wate" should be -- water --.

Col. 6, line 46, Claim 1, "said", first occurrence, not in application

Signed and Sealed this

Second Day of December 1980

[SEAL]

Attest:

SIDNEY A. DIAMOND

Attesting Officer

Commissioner of Patents and Trademarks